US012564211B2

(12) United States Patent
Benni et al.

(10) Patent No.: US 12,564,211 B2
(45) Date of Patent: Mar. 3, 2026

(54) ELASTIC CONTACT ELEMENT FOR WRAPPING A SHEET AROUND A GROUP OF SEGMENTS

(71) Applicant: PHILIP MORRIS PRODUCTS S.A., Neuchatel (CH)

(72) Inventors: Gabriele Benni, Sasso Marconi (IT); Fulvio Pastore, Bologna (IT); Marco Esposti, Casalecchio di Reno (IT); Giuliano Gamberini, Crevalcore (IT)

(73) Assignee: Philip Morris Products S.A., Neuchatel (CH)

( * ) Notice: Subject to any disclaimer, the term of this patent is extended or adjusted under 35 U.S.C. 154(b) by 684 days.

(21) Appl. No.: 17/785,125

(22) PCT Filed: Dec. 21, 2020

(86) PCT No.: PCT/EP2020/087437
§ 371 (c)(1),
(2) Date: Jun. 14, 2022

(87) PCT Pub. No.: WO2021/123425
PCT Pub. Date: Jun. 24, 2021

(65) Prior Publication Data

US 2023/0009973 A1 Jan. 12, 2023

(30) Foreign Application Priority Data

Dec. 20, 2019 (EP) ..... 19218558

(51) Int. Cl.
*A24C 5/47* (2006.01)
*A24C 5/18* (2006.01)
(Continued)

(52) U.S. Cl.
CPC ..... *A24C 5/471* (2013.01); *A24C 5/18* (2013.01); *A24D 1/04* (2013.01); *A24D 1/22* (2020.01)

(58) Field of Classification Search
None
See application file for complete search history.

(56) References Cited

U.S. PATENT DOCUMENTS 2,952,105 A 9/1960 Schur
3,036,581 A 5/1962 Dearsley
(Continued)

FOREIGN PATENT DOCUMENTS

EP 2813153 12/2014
GB 2148692 6/1985
(Continued)

OTHER PUBLICATIONS

Netzsch, NR: Natural Rubber; https://analyzing-testing.netzsch.com/en-US/polymers-netzsch-com/elastomers/nr-natural-rubber retrieved online Apr. 4, 2025. (Year: 2025).*
(Continued)

*Primary Examiner* — Manley L Cummins, IV
(74) *Attorney, Agent, or Firm* — Mueting Raasch Group

(57) ABSTRACT

A wrapping device 1 for wrapping a sheet 3 around a group 5 of segments comprises a wrapping conveyor 7 and a contact element 25. The wrapping conveyor 7 comprises a conveyor surface 9 for receiving the group 5 of segments. The contact element 25 provides a counter surface 31. The counter surface 31 is arranged at a distance to the conveyor surface 9 of the wrapping conveyor 7. The counter surface 31 faces the conveyor surface 9 of the wrapping conveyor 7. The counter surface 31 is configured to engage the group 5 of segments and the sheet 3 when the group 5 of segments is moved along the counter surface 31 by the wrapping
(Continued)

conveyor 7 to cause rotation of the group 5 of segments to wrap the group 5 of segments with the sheet 3. At least a first portion 41 of the contact element 25 comprising at least a first part 35 of the counter surface 31 is formed by a first material being an elastic material having a shore hardness between 30 A and 70 A.

11 Claims, 2 Drawing Sheets

(51) Int. Cl.
*A24D 1/04* (2006.01)
*A24D 1/22* (2020.01)

(56) References Cited

U.S. PATENT DOCUMENTS

| | | | | |
|---|---|---|---|---|
| 3,527,234 | A | 9/1970 | Hinzmann | |
| 4,527,570 | A * | 7/1985 | Porenski | A24C 5/471 131/94 |
| 2013/0118510 | A1* | 5/2013 | Kaljura | A24D 1/025 131/331 |
| 2015/0291301 | A1 | 10/2015 | Cadieux | |
| 2016/0157518 | A1* | 6/2016 | Emmet | A24C 5/47 131/58 |

FOREIGN PATENT DOCUMENTS

| | | | |
|---|---|---|---|
| WO | WO 2015/022347 | 2/2015 | |
| WO | WO 2019/142139 | 7/2019 | |
| WO | WO-2019142139 A1 * | 7/2019 | A24C 5/471 |

OTHER PUBLICATIONS

OBT Custom Rubber Parts, How to measure the hardness: shore A,B,C,D?; https://rubberproducer.com/shore-hardness-a-c-d-hardness-comparison/ (retrieved online Apr. 4, 2025). (Year: 2025).*
PCT Search Report and Written Opinion for PCT/EP2020/087437 dated Mar. 19, 2021 (10 pages).
International Preliminary Report on Patentability dated Mar. 18, 2022 (17 pages).
Kosso et al., "Mechanical Properties of Rubbers Reinforced with Porcellinite-Derived Precipitated Silica", Fall 170$^{th}$ Technical Meeting of the Rubber Division, American Chemical Society, Feb. 22, 2007.

* cited by examiner

ELASTIC CONTACT ELEMENT FOR WRAPPING A SHEET AROUND A GROUP OF SEGMENTS

This application is a U.S. National Stage Application of International Application No. PCT/EP2020/087437 filed Dec. 21, 2020, which was published in English on Jun. 24, 2021, as International Publication No. WO 2021/123425 A1. International Application No. PCT/EP2020/087437 claims priority to European Application No. 19218558.5 filed Dec. 20, 2019.

The invention relates to wrapping a sheet around a group of segments. In particular, the invention relates to wrapping a sheet around a group of segments in order to produce a rod-shaped article. The rod-shaped article may be a smoking article.

WO 2015/022347 A2 discloses a method for producing a smoking article. An assembly of segments is arranged in an end-to-end relationship and an outer periphery of the assembly is affixed longitudinally to an edge portion of a piece of wrapping material. The assembly of segments provided with the piece of wrapping material is supplied to a rolling seat arranged in a peripheral surface of a wrapping conveyor. A retaining surface is provided at a distance and opposite the peripheral surface of the wrapping conveyor. The assembly of segments is wrapped with the piece of wrapping material by moving the wrapping conveyor relative to the retaining surface. Thereby, the rolling seat provides two guiding contacts to the assembly of segments and the retaining surface provides one guiding contact to the assembly of segments. The three-point guiding contact for the assembly of segments is intended to provide secure and safe guiding and wrapping under controlled conditions. Providing the three-point guiding contact is stated to make the wrapping method particularly suitable for assemblies comprising rigid and incompressible segments, as wrapping material is always kept taught around the outer surface of the assembly of segments due to the constant pressure that can be applied at three points at the same time.

US 2015/0291301 A1 discloses a rotatable drum used in an automatic manufacturing process of e-vapor devices. A roll face of a drum body of the rotatable drum defines a plurality of pockets therein. In each of the pockets of the drum body, a seat structure is mounted to define a grove facing outward from the drum body to receive and hold a cartridge of an e-vapor device. The seat structure includes a material that is more structurally yielding than a material of the cartridge of the e-vapor device. Vacuum ports are provided in the seat structure to provide a retention force to hold the cartridge in the seat structure. The yieldable nature of the resilient material of the seat structure promotes a more complete seal of the cartridge at the vacuum port, which enhances the vacuum retention force applied to the cartridge.

GB 2 148 692 A describes a device for attaching two cylindrical tobacco columns to an intermediately disposed double-length rigid mouthpiece by wrapping a sheet of tipping material around the double-length rigid mouthpiece and a portion of each tobacco column to form a cigarette group. It is stated that due to the rigid mouthpieces being fabricated of a smooth, hard plastic material with a relatively low coefficient of friction, the double length mouthpiece-tobacco column group tends to slide rather than roll through a rolling device leading to incomplete wrapping. It is further stated that while increasing the force exerted by the rolling device on the mouthpiece will increase friction between the rolling device and the mouthpiece, the mouthpiece will crack if the force exerted against it is too great. It is proposed to use a stationary rolling block that comprises a middle contact zone for engaging the rigid mouthpiece and side contact zones for engaging parts of the double length cigarette extending to both sides of the mouthpiece. The middle contact zone and the side contact zones are mutually co-extensive. The middle contact zone is fabricated of a relatively soft, resilient material having a relatively high coefficient of friction with the mouthpiece to avoid slippage of the mouthpiece during rolling.

Other devices for producing smoking articles are known from U.S. Pat. No. 3,036,581 A and 3,527,234 A, for example.

It is desirable to provide a way of wrapping a sheet around a group of segments that yields good results for segments of different properties. It is desirable to provide a way of wrapping a sheet around a group of segments that provides improved quality of the rolled product. It is desirable to provide a highly reliable way of wrapping a sheet around a group of segments. It is desirable to provide a way of wrapping a sheet around a group of segments that can be carried out in a structurally simple manner. There is a need for an improved way of wrapping a sheet around a group of segments that comprises at least one rigid segment. There is a need for an improved way of wrapping a sheet around a group of segments, wherein at least one of the segments has different physical properties from at least another one of the segments. There is a need to provide an improved way of wrapping a sheet around a group of segments to form a smoking article.

According to an aspect, the invention provides a wrapping device for wrapping a sheet around a group of segments. The wrapping device comprises a wrapping conveyor and a contact element. The wrapping conveyor comprises a conveyor surface for receiving the group of segments. The contact element provides a counter surface. The counter surface is arranged at a distance to the conveyor surface of the wrapping conveyor. The counter surface faces the conveyor surface of the wrapping conveyor. The counter surface is configured to engage the group of segments and the sheet when the group of segments is moved along the counter surface by the wrapping conveyor to cause rotation of the group of segments to wrap the group of segments with the sheet. The contact element has a first portion comprising at least a first part of the counter surface. The first portion of the contact element is formed by a first material. The first material is an elastic material having a shore hardness between 30 A and 70 A.

The shore hardness of the first material, and any other shore hardness described herein, may be determined according to ASTM D2240. The shore hardness is a measure of how deep a standardized presser tool immerses into the material, when pressed into the material by a given force and under given test conditions.

Due to the first material being elastic and having a shore hardness between 30 A and 70 A, the first part of the counter surface may exhibit a behavior during wrapping of the group of segments between the conveyor surface and the counter surface that automatically adjusts to the properties of one or more segments coming in contact with the first part of the counter surface.

A rigid segment may compress the first material. Compression of the first material may reduce tension in the rigid segment during wrapping of the rigid segment between the conveyor surface and the counter surface. Damage to the rigid segment during the rolling process may be less likely. Further, traction between the rigid segment and the counter surface may be improved, thereby improving wrapping efficiency. Examples for rigid segments are heat sources for smoking articles, or carbon-based heat sources for smoking articles, or rigid mouthpieces for smoking articles.

A segment comprising relatively compressible material may not compress the first material or may compress the first material to a lesser degree than a rigid segment. A segment comprising relatively compressible material may be compressed during rolling between the conveyor surface and the first part of the counter surface. After rolling is completed, the segment comprising relatively compressible material may return into its initial configuration and may thereby tighten the sheet wrapped around the group of segments. Examples for segments comprising relatively compressible material are columns of tobacco material, or compressible filters for smoking articles.

It may be beneficial, if the first part of the counter surface engages at least one rigid segment, as the first material may serve to prevent damaging the rigid segments during rolling. However, the first part of the counter surface may alternatively or in addition also engage at least one segment comprising relatively compressible material.

The first material may have a shore hardness between 30 A and 60 A, or a shore hardness between 30 A and 50 A, or a shore hardness between 40 A and 50 A. The first material may have a Young modulus of elasticity of less than 20 MPa, or of less than 15 MPa, or of less than 10 MPa, or of less than 5 MPa, or of less than 3 MPa, or of less than 2.5 MPa.

The first portion of the contact element may have as thickness of at least 1 mm, or of at least 2 mm, or of at least 4 mm, or of at least 6 mm, or of at least 8 mm, or of at least 10 mm. A thickness of the first portion of the contact element may be sufficient to allow segments of the group of segments to deform the first portion of the contact element enough to avoid damage to the segments.

A second portion of the contact element may comprise a second part of the counter surface. The second part of the counter surface may be different from the first part of the counter surface. The second portion of the contact element may have different elastic properties than the first portion of the contact element. The first portion of the contact element and the second portion of the contact element may be arranged to contact the group of segments at different positions. The first portion of the contact element and the second portion of the contact element may be arranged to contact different segments of the group of segments. The first portion of the contact element and the second portion of the contact element may exhibit different deformation characteristics.

Providing different portions of the contact element exhibiting different elastic properties may ensure that different positions at the group of segments are exhibited to parts of the counter surface having different properties during rolling. The counter surface may be specifically designed to fit the specific requirements of a respective group of segments.

The first portion of the contact element and the second portion of the contact element may be formed by the same material. In this case, the contact element may be particularly easy to manufacture.

Alternatively, the first portion of the contact element and the second portion of the contact element may be formed by different materials. This may facilitate appropriately adjusting the elastic properties of the first portion of the contact element and the second portion of the contact element. The second portion of the contact element may be formed by a second material. The second material may be different from the first material. The second material may have a higher shore hardness than the first material. The second material may have a shore hardness of at most 100 A, or of at most 90 A, or of at most 80 A, or of at most 70 A.

The first portion of the contact element and the second portion of the contact element may have different thicknesses. Adjusting the thickness of a portion of the contact element may influence the reaction of the portion of the contact element, when a segment of the group of segments is pressed onto the portion of the contact element. For example, if the thickness of a portion of the contact element is increased, it may be easier for a segment of the group of segments to deform the portion of the contact element.

The wrapping conveyor may comprise a rotatable roller. The rotatable roller may comprise a circumferential surface defining the conveyor surface for receiving the group of segments. Alternatively, the wrapping conveyor may comprise a linear conveyor. The linear conveyor may comprise at least one conveyor belt or a linearly moveable element defining the conveyor surface for receiving the group of segments.

A shape of the counter surface provided by the contact element may follow a shape of the conveyor surface of the wrapping conveyor. For example, if the conveyor surface of the wrapping conveyor essentially corresponds to a circumferential surface of a cylinder, the counter surface may follow a corresponding arc shape. For example, if the conveyor surface of the wrapping conveyor is a plane surface, the counter surface provided by the contact element may also be a plane surface.

A distance between the conveyor surface of the wrapping conveyor and the counter surface provided by the contact element may be in the range of or smaller than a maximum diameter of the group of segments. For example, the distance between the conveyor surface of the wrapping conveyor and the counter surface provided by the contact element may be at least 0.7 times the maximum diameter of the group of segments, or at least 0.8 times the maximum diameter of the group of segments, or at least 0.9 times the maximum diameter of the group of segments.

The conveyor surface may define grooves for receiving the group of segments. The grooves may be oriented perpendicular to a conveying direction of the group of segments. The group of segments may be rotated within a groove, when the group of segments is moved along the counter surface by the wrapping conveyor. The segments of the group of segments may be received in the groove in an end-to-end relation. The segments of the group of segments may be positioned one behind the other along a direction of extension of the groove.

Friction between the group of segments and the grooves may be lower than friction between the group of segments and the contact element. Friction between the sheet and the grooves may be lower than friction between the sheet and the contact element. The diameters of the segments of the group of segments may be the same or essentially the same for all segments. A maximum deviation between the diameters of different segments of the group of segments may be lower than 5 mm, or lower than 4 mm, or lower than 3 mm, or lower than 2 mm, or lower than 1 mm.

The segments of the group of segments may be essentially rod-shaped segments. The segments of the group of segments may be essentially cylindrically shaped. The segments of the group of segments may be segments of a smoking article.

At least a part of the conveyor surface of the wrapping conveyor may be formed by a third material. The third material may be an elastic material. The third material may have a shore hardness between 30 A and 70 A. The third material may be the same as the first material. The third material may be the same as the second material. The third material may be susceptible to deformation by one or more segments of the group of segments during wrapping of the group of segments between the conveyor surface and the counter surface. If a segment is capable of deforming the third material, the likelihood of damaging the segment during wrapping may be reduced.

The wrapping device may further comprise a heater configured to heat the contact element. The heater may be integrated into the contact element. The heater may be configured to heat the counter surface of the contact element. The heater may comprise an electrical resistance heating element or a radiation heater, for example. The heater may be configured to heat the counter surface of the contact element to a temperature between 40 degrees Celsius and 80 degrees Celsius, or a temperature between 40 degrees Celsius and 70 degrees Celsius, or a temperature between 40 degrees Celsius and 60 degrees Celsius. Heating the contact element may dry the group of segments and the sheet during wrapping. Further, heating the contact element may contribute to curing a glue fixing the sheet at the group of segments.

The invention also provides a system for producing a smoking article. The system comprises the wrapping device for wrapping a sheet around a group of segments as described herein. Further, the system comprises the sheet and the group of segments. The group of segments may comprise segments of a smoking article.

The segments of the smoking article may comprise one or more of a segment comprising a heat source for a smoking article, and a segment comprising tobacco material, and a segment comprising a filter for a smoking article, and a segment comprising a mouthpiece for a smoking article.

The sheet may be of any suitable material. For example, the sheet may comprise paper material. The sheet may be a coated sheet. For example, the sheet may be a metallized paper sheet. The sheet may be coated with polymer.

The invention also provides a method for wrapping a sheet around a group of segments. The wrapping device and the system according to the invention may be adapted, designed and configured to carry out the method. Features described in the context of the wrapping device or the system may also be used to describe the method, and vice versa.

The method comprises driving a wrapping conveyor to convey the group of segments on a conveyor surface of the wrapping conveyor to run along a counter surface of a contact element facing the conveyor surface. The group of segments engages the counter surface and is thereby caused to rotate so that the group of segments is wrapped with the sheet. At least a rigid segment of the group of segments elastically deforms the counter surface away from the conveyor surface.

The elastic deformation of the counter surface away from the conveyor system may take up force exerted on the rigid element during wrapping. Taking up at least some of that force may reduce the likelihood of damaging the rigid segment during rolling of the rigid element between the conveyor surface and the counter surface. Further, there may be particularly good traction between the rigid segment and the counter surface, when the rigid segment deforms the counter surface away from the conveyor surface, thus facilitating wrapping the sheet around the group of segments between the conveyor surface and the counter surface.

The deformation of the counter surface by the rigid segment may be such that due to the deformation of the counter surface, a distance between at least a part of the deformed section of the countersurface and the conveying surface increases by at least 0.1 mm, or by at least 0.3 mm, or by at least 0.5 mm, or by at least 0.7 mm, or by at least 1 mm.

The rigid segment may be a segment of a smoking article. The rigid segment may comprise a non-cuttable object.

The rigid segment may comprise a heat source. The heat source may be a heat source for a smoking article. The heat source may have the shape of a cylindrical plug. The heat source may comprise carbon particles. The heat source may comprise compressed powder of grounded carbon elements. The heat source may comprise an oxidizing agent. The heat source may be an electric heat source, or a combustible heat source, or a chemical heat source.

The invention is particularly advantageous when wrapping a group of segments comprising a rigid segment that is a carbon-based heat source for a smoking article. Carbon-based heat sources for smoking articles may be particularly susceptible to damage during the wrapping process. For example, application of excessive pressure during rolling may break the heat source during wrapping or may damage the heat source by compressing the constituent particles of the heat source so that gas generated in the heat source during combustion in the heat source may have difficulties leaving the heat source.

The group of segments may comprise, in addition to the rigid segment, one or more of a segment comprising tobacco material, and a segment comprising a filter for a smoking article, and a segment comprising a mouthpiece for a smoking article.

An elasticity of the counter surface may be different for different parts or regions of the counter surface. For example, parts of the counter surface coming in contact with the rigid segment may be more easily deformable than parts of the counter surface coming in contact with a segment comprising relatively compressible material. This may help to ensure that a co-axial alignment of the segments of the group of segments is maintained during wrapping of the sheet around the group of segments.

The invention further provides a use of a contact element having at least a first portion made of an elastic material having a shore hardness between 30 A and 70 A as a counter surface for wrapping a group of segments in a sheet of wrapping material. The use of the contact element may be applied to produce a smoking article.

An elasticity of the counter surface may be different for different parts or regions of the counter surface. For example, parts of the counter surface coming in contact with a rigid segment may be more easily deformable than parts of the counter surface coming in contact with a segment comprising relatively compressible material. Features described with respect to the wrapping device, the system for producing a smoking article and the method for wrapping a sheet around a group of segments may also be used to describe the use of the contact element.

In the following, the invention will be further described by describing embodiments with reference to the figures.

Figure 4:
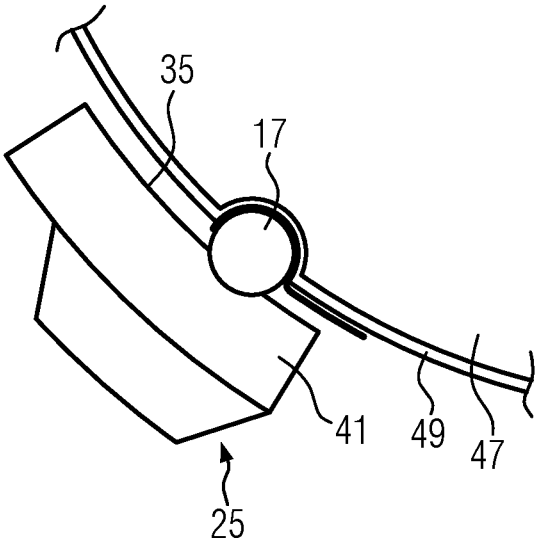

FIG. 4 schematically shows a sheet being wrapped around a group of segments between the conveyor surface and the counter surface in the wrapping device according to the embodiment.

Figure 1:
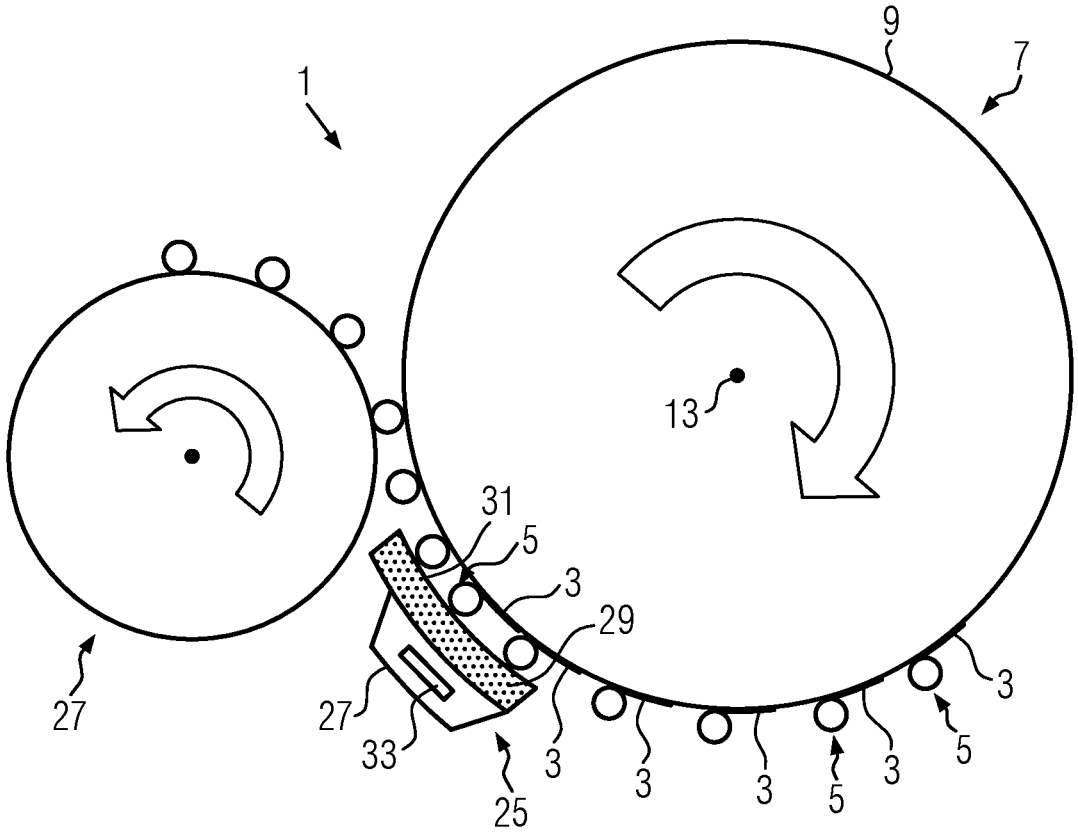
FIG. 1 shows a schematic side view of a wrapping device according to an embodiment.

FIG. 1 shows a schematic side view of a wrapping device 1 according to an embodiment. The wrapping device 1 is configured for wrapping a sheet 3 around a group 5 of segments. The segments of the group 5 of segments may be cylindrically shaped or rod shaped, for example. The segments of the group 5 of segments may be longitudinally aligned with each other in an end-to-end relationship, when wrapped with the sheet 3. The wrapping device 1 comprises a wrapping conveyor 7 for receiving groups 5 of segments. In the illustrated embodiment, the wrapping conveyor 7 comprises a rotatable roller defining a conveyor surface 9 for receiving the groups 5 of segments on its outer circumferential surface.

Figure 2:
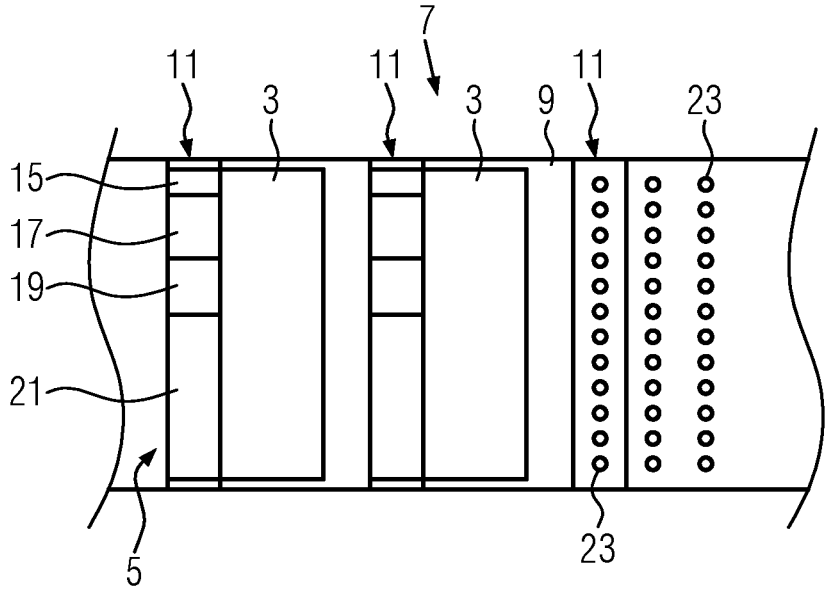
FIG. 2 shows a top view onto the conveying surface of the wrapping conveyor of the wrapping device according to the embodiment showing two grooves being occupied by groups of segments and one empty groove.

FIG. 2 shows a plan view onto the conveyor surface 9 of the wrapping conveyor 7. The conveyor surface 9 defines grooves 11 extending in parallel to an axis of rotation 13 (see FIG. 1) of the wrapping conveyor 7. Each of the grooves 11 is configured to receive a group 5 of segments to be wrapped with a sheet 3. In FIG. 2, the left two grooves 11 are occupied by a group 5 of segments, respectively. The right groove 11 is empty. In the illustrated embodiment, the groups 5 of segments comprise segments of a smoking article. In a groove 11, the segments of a group 5 of segments are arranged one behind the other in an end-to-end relationship.

According to the embodiment illustrated in FIG. 2, a group 5 of segments comprises a cap segment 15 comprising a removable cap for a smoking article, a heat source segment 17 comprising a heat source for a smoking article, a tobacco material segment 19 comprising tobacco material, and a diffuser segment 21 comprising a diffuser for a smoking article. The group 5 of segments might, additionally or as an alternative to one of the illustrated segments, comprise a filter segment comprising a filter for a smoking article. The group 5 of segments might, additionally or as an alternative to one of the illustrated segments, comprise a mouthpiece segment comprising a mouthpiece of a smoking article. By wrapping the sheet 3 around the group 5 of segments, the segments of the group 5 of segments will be combined. The group 5 of segments may comprise all required segments of a smoking article. Alternatively, the group 5 of segments may comprise only a subset of all the segments required for production of the smoking article and additional segments may be added in subsequent steps. In the illustrated embodiment, a part of a smoking article is formed by wrapping the sheet 3 around the cap segment 15, the heat source segment 17, the tobacco segment 19 and the diffuser segment 21. Later, a filter segment and a mouthpiece segment will be added in another wrapping step. It would, however, also be conceivable to include the filter segment and the mouthpiece segment in the first wrapping step.

The sheets 3 to be wrapped around the groups 5 of segments are also received on the conveyor surface 9 of the wrapping conveyor 7. A front edge of the sheet 3 may reach into the groove 11 and lie below the group 5 of segments received in the groove 11. Preferably, the front edge of the sheet 3 is glued to the group 5 of segments to establish an initial connection between the group 5 of segments and the sheet 3. The sheets 3 may be cut from a supply roll, provided with glue strips at the front edge and at the rear edge and be supplied to the conveyor surface 9 of the supply roll 7 so that the front edges of the sheets 3 reach into grooves 11 of the conveyor surface 9. Subsequently, the groups 5 of segments may be deposited in the grooves 11 of the conveyor surface 9 to come into contact with the glue strip at the front edge of the sheet 3. Alternatively, the sheets 3 and the groups 5 segments may be glued together first and then be supplied to the conveyor surface 9 as a unit. After the sheet 3 has been wrapped around the group 5 of segments, as will be described later, the sheet will be fixed by the glue strip at the rear edge of the sheet 3.

To ensure adhesion between the sheets 3 and the conveyor surface 9 during rotation of the wrapping conveyor 7, suction holes 23 are provided in the conveyor surface 9. The sheets 3 are held at the conveyor surface 9 by under-pressure applied to the suction holes 23. There may be suction holes 23 provided in the grooves 11 of the conveyor surface 9 and between the grooves 11 of the conveyor surface 9.

The wrapping device 1 further comprises a contact element 25. The contact element 25 comprises a main body 27 and a contact body 29 attached thereto. The contact body 29 provides a counter surface 31. The counter surface 31 is arranged at a distance to the conveyor surface 9 of the wrapping conveyor 7. The counter surface 31 extends essentially parallel to the conveyor surface 9 of the wrapping conveyor 7 and faces the conveyor surface 9 of the wrapping conveyor 7.

When a group 5 of segments is conveyed by rotation of the wrapping conveyor 7 between the conveyor surface 9 of the wrapping conveyor 7 and the counter surface 31 of the contact element 25, the group 5 of segments engages the counter surface 31 of the contact element 25. When the group 5 of segments is moved along the counter surface 31 of the contact element 25 by continued rotation of the wrapping conveyor 7, friction between the counter surface 31 of the contact element 25 and the group 5 of segments causes the group 5 of segments to rotate about its own axis, thereby wrapping the sheet 3 around the group 5 of segments. When the group 5 of segments leaves the gap between the wrapping conveyor 7 and the contact element 25, the sheet 3 has been completely wrapped around group 5 of segments. Downstream of the contact element 25, the group 5 of segments wrapped with the sheet 3 may be transferred from the wrapping conveyor 7 to another conveyor 27 for further processing.

The contact element 25 is provided with a heater 33 for heating the contact element 25. This may contribute to drying the group 5 of segments and to curing the glue strips.

Figure 3:
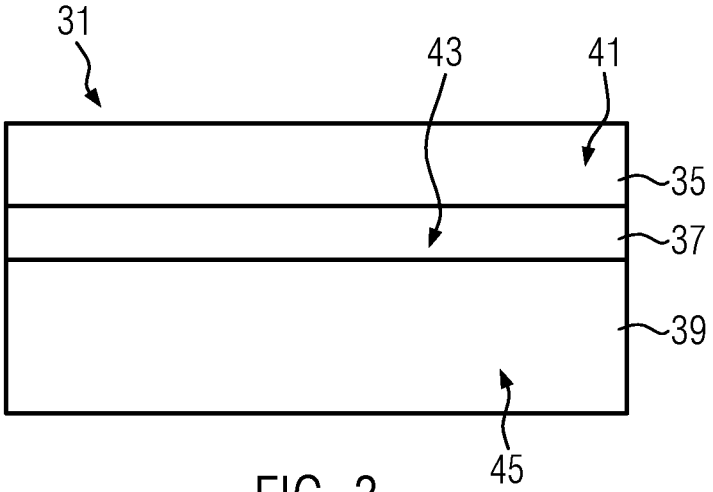
FIG. 3 shows a schematic view onto the counter surface provided by the contact element of the wrapping device according to the embodiment.

FIG. 3 shows a plan view onto the counter surface 31 of the contact element 25. A left-right direction in FIG. 3 corresponds to the conveying direction along which the groups 5 of segments are moved along the counter surface 31. The up-down direction in FIG. 3 corresponds to a direction along which the segments of the group 5 of segments are arranged one behind the other. The up-down direction in FIG. 3 is parallel to the rotations axis 13 of the wrapping conveyor 7.

In the illustrated embodiment, the counter surface 31 of the contact element 25 is divided into three parts. A first part 35 of the counter surface 31 is arranged to come in contact with the cap segment 15 and the heat source segment 17 of the group 5 of segments. A second part 37 of the contact surface 31 is arranged to come in contact with the tobacco segment 19 of the group 5 of segments. A third part 39 of the counter surface 31 is arranged to come in contact with the diffuser segment 21 of the group 5 of segments. The first part 35 of the counter surface 31 is defined by a first portion 41 of the contact element 25. The second part 37 of the counter surface 31 is defined by a second portion 43 of the contact element 25. The third part 39 of the counter surface 31 is defined by a third portion 45 of the contact element 25. The first portion 41, the second portion 43, and the third portion 45 of the contact element 25 are portions of the contact body 29 of the contact element 25.

The first portion 41 of the contact element 25 is formed by a first material. The first material is a material having a shore hardness between 30 A and 70 A. According to embodiments, the first material may have a shore hardness between 30 A and 60 A, or a shore hardness between 30 A and 50 A, or a shore hardness between 40 A and 50 A. The first material may have a Young modulus of elasticity of less than 20 MPa, or of less than 15 MPa, or of less than 10 MPa, or of less than 5 MPa, or of less than 3 MPa, or of less than 2.5 MPa. The first portion of the contact element may have as thickness of at least 1 mm, or of at least 2 mm, or of at least 4 mm, or of at least 6 mm, or of at least 8 mm, or of at least 10 mm.

FIG. 4 shows a cross-sectional view illustrating engagement between the heat source segment 17 of a group 5 of segments and the first part 35 of the counter surface 31 during wrapping of the sheet 3 around the group 5 of segments. Due to the material properties of the first portion 41 of the contact element 25, the heat source segment 17 may deform the first part 35 of the counter surface 31 away from the conveyor surface 9. The heat source segment 17 may immerse into the first portion 41 of the contact element 25. This may protect the heat source segment 17 from being damaged due to too much pressure exerted onto the heat source segment 17 upon wrapping between the conveyor surface 9 and the counter surface 31.

The second portion 43 of the contact element 25 may have different elastic properties than the first portion 41 of the contact element 25. The second portion 43 of the contact element 25 may be formed by a second material having a higher shore hardness than the first material.

In particular, a shore hardness of the second material may be higher than the shore hardness of the first material, but not higher than 90 A or not higher than 100 A. The second part 37 of the counter surface 31 comes in contact with the tobacco segment 19 during wrapping of the sheet 3 around the group 5 of segments. The tobacco segment 19 may in itself be compressible. It may be advantageous, if the tobacco segment 19 is compressed between the conveyor surface 9 and the counter surface 31. There may be no or substantially no deformation of the second part 37 of the counter surface 31 by the tobacco segment 19 upon wrapping of the group 5 of segments between the conveyor surface 9 and the counter surface 31.

The diffuser segment 21 may be essentially non-compressible and may be susceptible to damage due to high pressure exerted on the diffuser segment 21. The third portion 45 of the contact element 25 may have elastic properties that are similar to the elastic properties of the first portion 41 of the contact element 25. In particular, the third portion 45 may also be formed by the first material. The diffuser segment 21 may be configured to elastically deform the third part 39 of the counter surface 31 away from the conveyor surface 9 upon wrapping the sheet 3 around the group 5 of segments between the conveyor surface 9 and the counter surface 31.

According to an embodiment, the first portion 41 of the contact element 25, the second portion 43 of the contact element 25, and the third portion 45 of the contact element 25 may have the same thickness. Alternatively, at least two of the first portion 41 of the contact element 25, the second portion 43 of the contact element 25, and the third portion 45 of the contact element 25 may have different thicknesses. For example, the thickness of the first portion 41 of the contact element 25 may be higher than the thickness of the second portion 43 of the contact element 25. The first portion 41 of the contact element 25 may have a higher thickness to allow for deformation of the first part 35 of the counter surface 31 away from the conveyor surface 9. The second portion 43 of the contact element 25 need not be deformed and may therefore have a lower thickness.

According to the embodiment shown in FIG. 4, a main body 47 of the wrapping conveyor 7 may be coated with a layer 49 of elastic material. The layer 49 of elastic material may be formed from a third material. The third material may, for example, be identical to the first material or the second material.

The invention claimed is:

1. A wrapping device for wrapping a sheet around a group of segments, the wrapping device comprising:

a wrapping conveyor comprising a conveyor surface for receiving the group of segments; and a contact element providing a counter surface, wherein the counter surface is arranged at a distance to the conveyor surface of the wrapping conveyor, wherein the counter surface faces the conveyor surface of the wrapping conveyor, and wherein the counter surface is configured to engage the group of segments and the sheet when the group of segments is moved along the counter surface by the wrapping conveyor to cause rotation of the group of segments to wrap the group of segments with the sheet, wherein at least a first portion of the contact element comprises at least a first part of the counter surface and is formed by a first material being an elastic material having a shore hardness between 30 A and 70 A, and wherein a second portion of the contact element comprises a second part of the counter surface and has different elastic properties than the first portion of the contact element, wherein the first portion of the contact element and the second portion of the contact element are arranged to contact the group of segments at different positions.

2. The wrapping device according to claim 1, wherein the first material has a shore hardness between 40 A and 50 A.

3. The wrapping device according to claim 1, wherein the first material has a Young modulus of elasticity of less than 20 MPa, or of less than 15 MPa, or of less than 10 MPa, or of less than 5 MPa, or of less than 3 MPa, or of less than 2.5 MPa.

4. The wrapping device according to claim 1, wherein the first portion of the contact element has a thickness of at least 1 mm, or at least 2 mm, or at least 4 mm, or at least 6 mm, or at least 8 mm, or at least 10 mm.

5. The wrapping device according to claim 1, wherein the first portion of the contact element and the second portion of the contact element have different thicknesses.

6. The wrapping device according to claim 1, wherein the second portion of the contact element is formed by a second material having a shore hardness of at most 100 A, or of at most 90 A.

7. The wrapping device according to claim 1, wherein the conveyor surface defines grooves for receiving the group of segments, the grooves being oriented perpendicular to a conveying direction of the group of segments.

8. The wrapping device according to claim 1, wherein the second portion of the contact element is formed by a second material having a higher shore hardness than the first material.

9. The wrapping device according to claim 1, wherein the wrapping conveyor comprises a main body coated with a layer of elastic material.

10. A system for producing a smoking article, the system comprising the wrapping device of claim 1;

the sheet; and the group of segments, wherein the group of segments comprises segments of a smoking article.

11. The system according to claim 10, wherein the segments of the smoking article comprise one or more of a segment comprising a heat source for a smoking article, and a segment comprising tobacco material, and a segment comprising a filter for a smoking article, and a segment comprising a mouthpiece for a smoking article.

* * * * *